US007287533B2

(12) United States Patent
Mackinder

(10) Patent No.: US 7,287,533 B2
(45) **Date of Patent: *Oct. 30, 2007**

(54) HAIR CURLING DEVICE

(76) Inventor: Vivienne J. Mackinder, 65 Topping Dr., Riverhead, NY (US) 11901

( * ) Notice: Subject to any disclaimer, the term of this patent is extended or adjusted under 35 U.S.C. 154(b) by 214 days.

This patent is subject to a terminal disclaimer.

(21) Appl. No.: 11/121,788

(22) Filed: May 4, 2005

(65) Prior Publication Data

US 2005/0205106 A1 Sep. 22, 2005

Related U.S. Application Data

(63) Continuation-in-part of application No. 10/458,757, filed on Jun. 10, 2003, now Pat. No. 7,017,590.

(51) Int. Cl.
*A45D 4/16* (2006.01)

(52) U.S. Cl. ..... 132/233

(58) Field of Classification Search ..... 132/207, 132/212, 220, 222, 223, 226, 227, 233, 243, 132/245, 247, 251, 262, 264, 229, 269, 271; 219/222, 226, 521, 385, 679; 607/101, 108, 607/109, 112, 114

See application file for complete search history.

(56) References Cited

U.S. PATENT DOCUMENTS

| | | | |
|---|---|---|---|
| 2,137,511 | A | 11/1938 | Sierad |
| 3,822,705 | A | 7/1974 | Pilotte |
| 3,900,035 | A | 8/1975 | Welch et al. |
| 3,902,508 | A | 9/1975 | Sliman, Sr. |
| 4,164,951 | A | 8/1979 | Shaler et al. |
| 4,592,358 | A | 6/1986 | Westplate |
| 4,676,247 | A | 6/1987 | Van Cleve |
| 5,025,816 | A | 6/1991 | Jones |
| 5,065,758 | A | 11/1991 | Whitehead et al. |

(Continued)

OTHER PUBLICATIONS

Web page selling Remington Rag Rollers H-2032, http://www.drugstore.com/qxp94494_333181_sespider/remington/heated_rag_rollers_h_2032.htm, pp. 1-3, copyright 2004 Remington Corporation (on p. 2) (cited as showing copyright date of 2004).*

(Continued)

*Primary Examiner*—Eduardo C. Robert
*Assistant Examiner*—David Comstock
(74) *Attorney, Agent, or Firm*—Kinney & Lange, P.A.

(57) ABSTRACT

A heatable hair curling device includes a plurality of hair curlers for winding up human hair and a thermally insulating carrier for retaining the curlers and insulating the curlers from heat loss prior to individual curler use. Each curler includes an elongate casing of flexible material having opposite first and second ends attachable to each other, a body, and an axial length. A heat absorbent material is contained within the body of each curler. The thermally insulating carrier has a length and includes an interior and an exterior piece of flexible heat-safe material. The interior piece of flexible heat-safe material is attached to the exterior piece of flexible heat-safe material. A center strap is disposed along the length of the interior piece the carrier and includes a lower and an upper piece of flexible heat-safe material. A heating element is contained between the interior and exterior pieces of flexible heat-safe material of the carrier and between the lower and upper pieces of flexible heat-safe material of the center strap.

19 Claims, 10 Drawing Sheets

U.S. PATENT DOCUMENTS

| | | | |
|---|---|---|---|
| 5,411,040 | A | 5/1995 | Forrest |
| 5,480,418 | A | 1/1996 | Zeoli-Jones |
| 5,665,057 | A | 9/1997 | Murphy |
| 5,676,871 | A | 10/1997 | Graves |
| 5,694,955 | A | 12/1997 | Grooms |
| 5,716,388 | A | 2/1998 | Petelle |
| 5,771,907 | A | 6/1998 | Dickson |
| 5,819,763 | A | 10/1998 | Hallowell, II |
| 5,988,182 | A | 11/1999 | Engelbrecht |
| 6,064,051 | A | 5/2000 | Gray |
| 6,068,122 | A | 5/2000 | Burns et al. |
| 6,079,422 | A | 6/2000 | Drago et al. |
| 6,352,080 | B1 | 3/2002 | Neville |
| 6,537,308 | B2 | 3/2003 | Burkhart |
| 6,631,725 | B2 | 10/2003 | Gray |
| 7,017,590 | B2 * | 3/2006 | Mackinder ..... 132/233 |

OTHER PUBLICATIONS

Article, http://www.remington-products.com/usa/products/haircare/hotrollers.html, Remington Products, Hot Rollers, For curls that set trends, pp. 1-2, 2005.

Article, http://www.remington-products.com/usa/products/haircaire/h2032.html, Remington Products, Hot Rollers, Rag Rollers, p. 1, 2005.

* cited by examiner

HAIR CURLING DEVICE

CROSS-REFERENCE TO RELATED APPLICATION(S)

This application is related to and a continuation-in-part of the application Ser. No. 10/458,757, filed on Jun. 10, 2003, and entitled "Microwavable Hair Curling Device", now U.S. Pat. No. 7,017,590 B2, which is herein incorporated by reference.

BACKGROUND OF THE INVENTION

The present invention relates to a hair curling device. In particular, the present invention relates to a heatable hair curling device that is effective, yet easy, safe, and time-efficient to use.

Numerous hair curling devices have been introduced over the years. Hair curling devices come in a variety of configurations, sizes, and materials. It is well known that the most efficient way to curl hair is with thermal energy. Hair can be curled in the absence of heat if the hair is wrapped around the curling device when it is wet and allowed to dry into a curl. However, waiting for hair to air dry takes a long time, making it inconvenient in today's fast paced world. In addition, rollers can be uncomfortable to wear, especially for long periods of time while waiting for hair to dry.

Most of the prior art hair curling devices employ an electrical heating means. A curling iron, while effective at curling hair quickly, gets extremely hot and can burn the hair and blister the skin, making it dangerous for the elderly and the young to use. In addition, a curling iron takes a long time to heat, possibly exposes the user to electric shock, and limits the user's movement to the range of the electric cord. Hot rollers, while they do not readily burn the skin or limit movement, are very hot to the touch and therefore hard to handle. In addition, hot rollers are heavy and have a tendency to fall out of the hair.

Microwave energy has also been used as a means for heating hair curling devices. U.S. Pat. Nos. 6,064,051, 6,079,422, 5,988,182, and 6,352,080 provide curlers which may be heated directly in the microwave. The known curlers contain a microwave heatable material which transfers energy from the curler to the hair, causing the hair to curl. The curlers hold the hair in place with pins, clips, ties, surface protrusions, or combs. In these cases, individual curlers are heated one at a time, immediately before being placed in the hair. If not placed immediately in the hair after being heated, the heat will dissipate from the curlers into the atmosphere. Also, the process of clipping, tying, or pinning the curler in place is cumbersome if being done by one person. This makes the process of heating and setting hair especially time consuming. Another problem with prior art microwavable hair curlers is that they can be easily lost or misplaced.

It is well known in the art of cosmetology that curling hair at higher temperatures results in longer lasting curls. Unfortunately, heat is also known in the art to dry hair out, eventually causing split ends and breakages. In addition, heat can be dangerous to the skin. Thus, there continues to be a need for a hair curling device whose use of heat does not dry out the hair, is warm (not hot) to the touch, is capable of withstanding high temperatures without melting or scorching, and is simple to wrap hair around and hold in place. The cylindrical roller shape of most prior art curlers gives the hair rigid, symmetrical, and ultimately unnatural looking curls. None of the prior art hair curling devices have been satisfactory. Thus, there exists a need for a hair curling system which is effective at curling, gentle on the hair, easy, safe, time-efficient, and capable of producing relaxed and natural looking curls.

BRIEF SUMMARY OF THE INVENTION

A heatable hair curling device of the present invention includes a plurality of hair curlers for winding up human hair and a thermally insulating carrier for retaining the curlers and insulating the curlers from heat loss prior to individual curler use. Each curler includes an elongate casing of flexible material having opposite first and second ends attachable to each other, a body, and an axial length. A heat absorbent material is contained within the body of each curler. The thermally insulating carrier has a length and includes an interior and an exterior piece of flexible heat-safe material. The interior piece of flexible heat-safe material is attached to the exterior piece of flexible heat-safe material. A center strap is disposed along the length of the interior piece the carrier and includes a lower and an upper piece of flexible heat-safe material. A heating element is contained between the interior and exterior pieces of flexible heat-safe material of the carrier and between the lower and upper pieces of flexible heat-safe material of the center strap.

DETAILED DESCRIPTION

Figure 1:
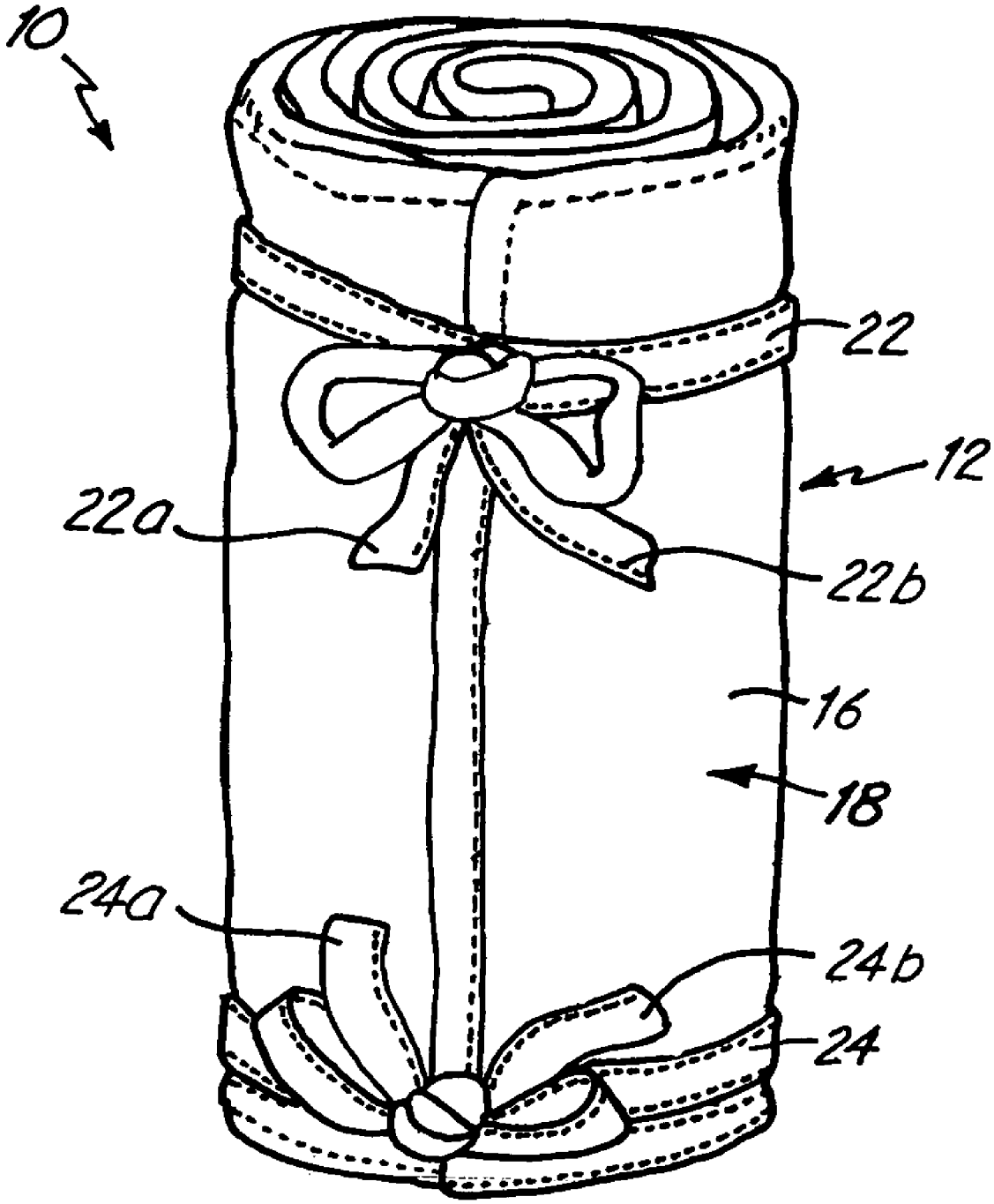
FIG. 1 is a perspective view of a first embodiment of a hair curling device of the present invention in a fully rolled configuration.

FIG. 1 is a perspective view of a first embodiment of hair curling device 10. Hair curling device 10 consists of a carrier 12 and a set of hair curlers 14 (shown in detail in FIG. 2). Carrier 12 includes a thermal insulating blanket 16 which, as shown in FIG. 1, may be rolled into a cylindrical shape. Blanket 16 has an exterior surface 18 and an interior surface 20 (shown in detail in FIG. 2) made of fire retardant fabric. Straps 22 and 24 are attached on exterior surface 18 of blanket 16. Free ends 22*a* and 22*b* of strap 22 are tied together and free ends 24*a* and 24*b* of strap 24 are tied together to hold carrier 12 in its fully rolled cylindrical shape. Devices other than straps 22 and 24 can be used to hold carrier 12 in its cylindrical shape so long as the device is fire retardant. Other embodiments of carrier 12 can be used as well. For example, blanket 16 may be simply folded so that it forms a flat carrier instead of a cylinder.

Surfaces 18 and 20 and straps 22 and 24 of blanket 16 are made of a fire-retardant fabric that is lightweight, flexible, machine washable and capable of withstanding temperatures of at least about 250° F. without scorching or melting. Preferably, blanket 16 is made out of fabrics with fire-retardant properties such as NOMEX®, NOVEON®, MILLENIA™, KOTHMEX™ or KYNOL™ brand materials. Blanket 16 preferably is capable of withstanding temperatures of at least about 600° F.

Figure 2:
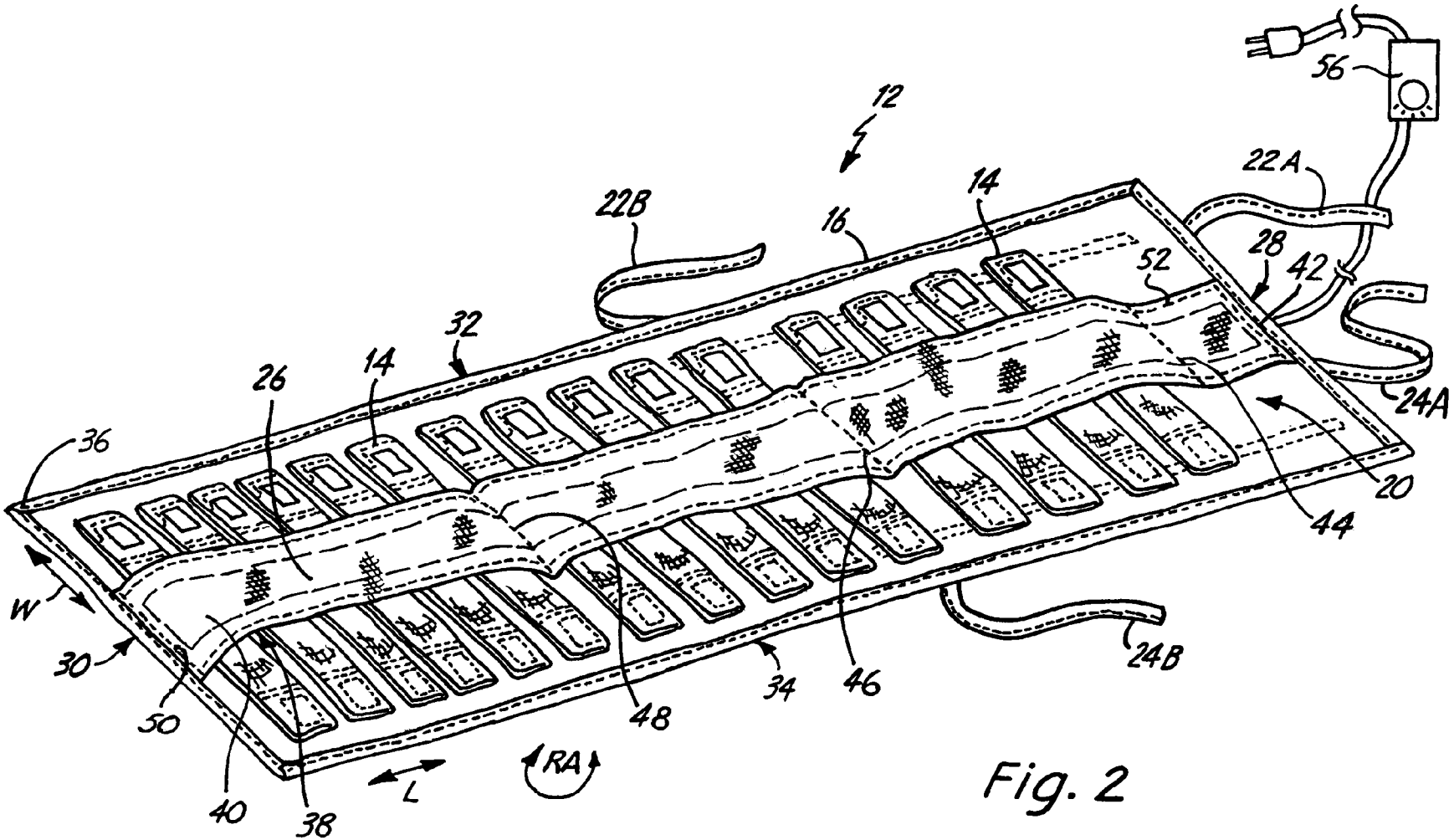
FIG. 2 is a perspective view of the first embodiment of the hair curling device of the present invention in a fully unrolled configuration exposing a set of hair curlers.

FIG. 2 shows carrier 12 after thermal blanket 16 is fully unrolled. When blanket 16 is fully unrolled, carrier 12 reveals interior surface 20, center strap 26 and set of hair curlers 14. Center strap 26 runs lengthwise down interior surface 20 of blanket 16. Hair curlers 14 are held in place under center strap 26. Curlers 14 will be discussed in more detail with reference to FIGS. 5A and 5B.

Interior surface 20 of blanket 16 is rectangular in shape having the following features: opposite first and second ends 28 and 30, opposite first and second side edges 32 and 34, length L, roll axis RA, width W, and seam 36. To reveal interior surface 20, blanket 16 is unrolled from first end 28 to second end 30 about roll axis RA. When fully unrolled, interior surface 20 is about twenty-nine inches long along length L. Interior surface 20 is about eight inches wide along width W when measured between side edges 32 and 34. First and second ends 28 and 30 run transverse to side edges 32 and 34. Interior surface 20 and exterior surface 18 (see FIG. 1) are stitched together at seam 36.

Center strap 26 is comprised of an interior piece 38 and an exterior piece 40 and is attached to interior surface 20 of blanket 16 at the following five attachment points: 42, 44, 46, 48, and 50; however, different embodiments of the present invention may differ in the number of attachment points, so long as at least one curler 14 is able to fit in between them. In FIG. 2, fifteen hair curlers 14 are secured under center strap 26 in between the aforementioned attachment points 42, 44, 46, 48, and 50. When placed under strap 26, curlers 14 are lined up side-by-side so that they are parallel to first and second ends 28 and 30 of interior surface 20. Center strap 26 is preferably made of the same fire-retardant material as blanket 16. The fabric is lightweight, flexible, machine washable and capable of withstanding temperatures of at least about 250° F.

Preferably, center strap 26 is made out of fabrics with fire retardant properties such as NOMEX®, NOVEON®, MILLENIA™, KOTHMEX™ or KYNOL™ brand materials. Hair curlers 14 may be held in place by devices other than center strap 26 so long as the device is fire-retardant, flexible, machine washable, and capable of holding curlers 14 side-by-side along interior surface 20.

Attachment points 42, 44, 46, 48, and 50 of center strap 26 keep curlers 14 organized so that thermal blanket 16 may be easily rolled into a cylindrical shape without curlers 14 falling out and becoming lost or misplaced. Carrier 12, complete with interior and exterior surfaces 20 and 18 of thermal blanket 16, center strap 26, and exterior straps 22 and 24, is designed to be fire-retardant, lightweight and machine washable. In addition, thermal blanket 16 is easy to roll and unroll, safe to use, easy to transport and an excellent place to store curlers in between uses.

Heating element 52 is housed between exterior and interior surfaces 18 and 20 of blanket 16 and between interior and exterior pieces 38 and 40 of center strap 26. Heating element 52 is shown in phantom within center strap 26 and is a resistance-type heating element similar to those used in electric heating pads and blankets. Heating element 52 is sewn inside carrier 12 and is capable of obtaining temperatures of at least about 275° F. In order for heating element 52 to operate, power cord 54 operatively connects heating element 52 to a power source. Control box 56 is either located in, or connected to, power cord 54 and controls the level of power supplied from the power source to heating element 52. The user can thus control the temperature of heating element 52 through control box 56.

Figure 3:
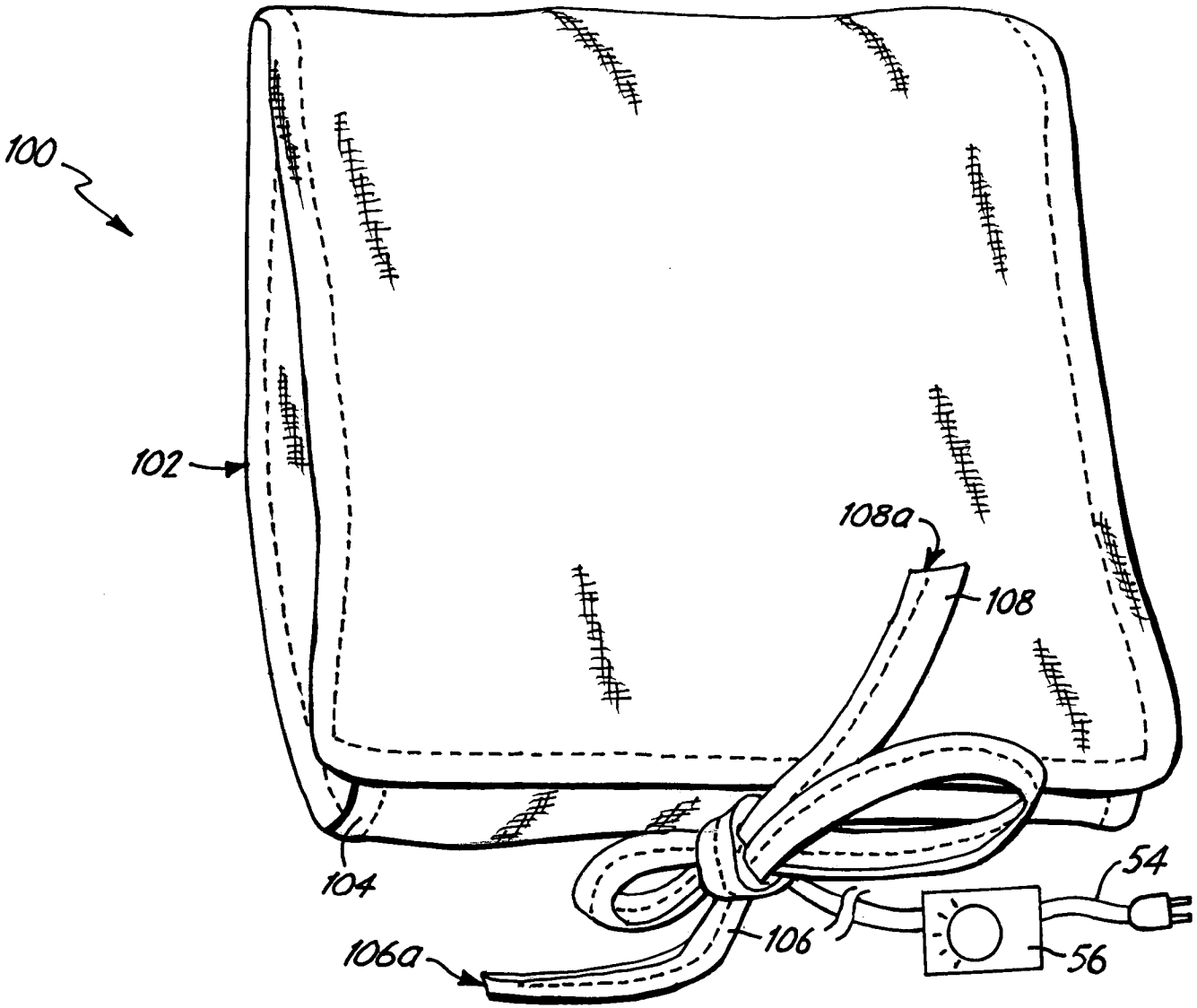
FIG. 3 is a perspective view of the first embodiment of the hair curling device of the present invention in a partially unrolled configuration.

FIG. 3 is a perspective view of a second embodiment of hair curling device 100. In the second embodiment of hair curling device 100, carrier 102 includes a heating and thermal insulating blanket 104 folded to form a flat carrier. Carrier 102 is held in its fully folded configuration by free end 106*a* of strap 106 and free end 108*a* of strap 108.

Figure 4:
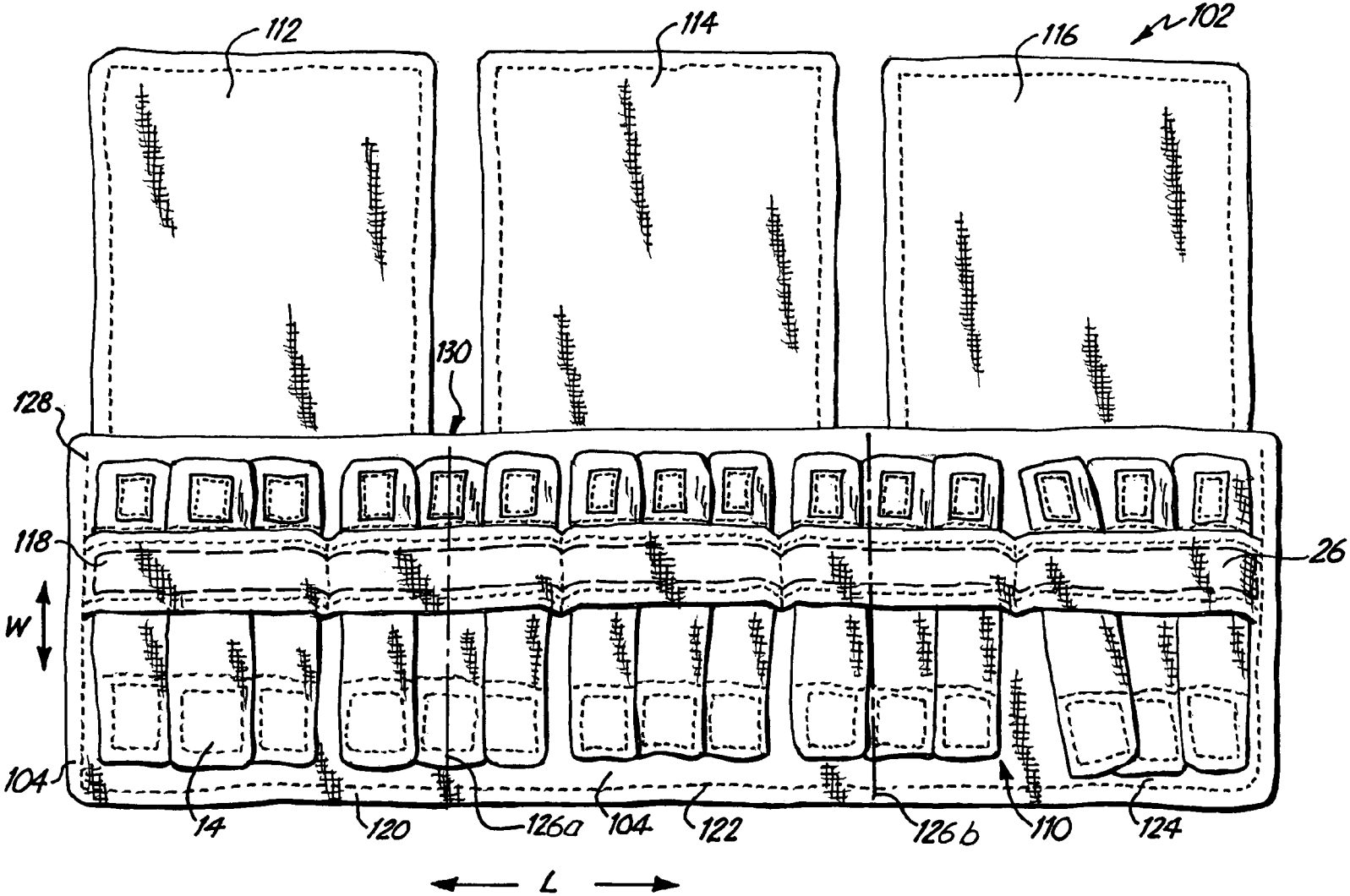
FIG. 4 is a perspective view of a second embodiment of the hair curling device of the present invention in a fully folded configuration.

FIG. 4 shows carrier 102 after blanket 104 is fully unfolded. When blanket 104 is fully unfolded, carrier 102 reveals interior surface 110, a first foldable extension 112, a center foldable extension 114, a second foldable extension 116, center strap 118, heating element 26 (shown in phantom), and hair curlers 14. Interior surface 110 of blanket 104 is rectangular in shape having the following features: first portion 120, center portion 122, second portion 124, length L, first fold axis 126*a* and second fold axis 126*b*, width W, and seam 128. First foldable extension 112 is attached to first portion 120 of blanket 104 at first side edge 130, center foldable extension 114 is attached to center portion 122 of blanket 104 at first side edge 130, and second foldable extension 116 is attached to second portion 124 of blanket 101 at first side edge 130. Foldable extensions 112, 114, and 116 have the same width W as interior surface 110 of blanket 104.

To open hair curling device 100 from the fully folded configuration shown in FIG. 3 to the fully unfolded configuration shown in FIG. 4, first portion 120 of blanket 104 is unfolded from center portion 122 about fold axis 126*a*. Second portion 124 of blanket 104 is then unfolded from center portion 122 about fold axis 126*b*. First foldable extension 112 is unfolded from first portion 120 at first side edge 130, center foldable extension 114 is unfolded from center portion 122 at first side edge 130, and second foldable extension 116 is unfolded from second portion 124 at first side edge 130.

Figure 5A:
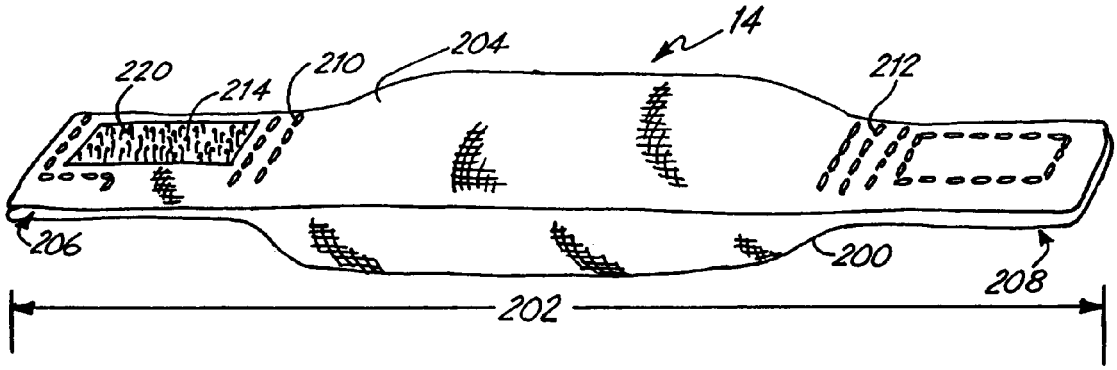
FIG. 5A is a side view of one embodiment of a hair curler of the present invention.

FIG. 5A shows one embodiment of hair curler 14. Hair curler 14 comprises the following features: outer casing 200, axial curler length 202, body 204, opposite first and second ends 206 and 208, first and second seams 210 and 212, first fastener 214, and second fastener 216 (shown in detail in FIG. 5B). Hair curler 14 is shaped like a rod and is about 7.5 inches long when measured along axial length 202 and about 1.25 inches wide. Both first end 206 and second end 208 are flat in order to accommodate the placement of first and second fasteners 214 and 216. First and second ends 206 and 208 each measure about 2.25 inches long and 1.25 inches wide. Body 204 of curler 14 is not flat and has a total circumference of about 2.5 inches when measured around its center. First and second seams 210 and 212 separate body 204 of curler 14 from flat ends 206 and 208. Body 204 of curler 14 measures about 3.5 inches along axial curler length 202 between first and second seams 210 and 212. Outer casing 200 of hair curler 14 is made out of fire-retardant fabric that is lightweight, flexible, machine washable, and capable of withstanding temperatures of at least about 250° F. Preferably, outer casing 70 is made out of fabric with fire-retardant properties such as NOMEX®, NOVEON®, MILLENIA™, KOTHMEX™ or KYNOL™ brand materials.

Fasteners 214 and 216 are preferably made of hook and loop material, capable of withstanding temperatures of at least about 250° F. First fastener 214 is disposed on the top of first end 206 while second fastener 216 is disposed on the bottom of second end 208. First fastener 214 is preferably composed of tiny loops 218 while second fastener 216 is composed of tiny hooks 220. Seams 210 and 212 protect ends 206 and 208 of curler 14 from getting too hot and damaging fasteners 214 and 216. The hook and loop fastening device used in this embodiment may be replaced by other machine washable, fire-retardant fastening devices so long as both ends 206 and 208 of curler 14 are capable of fastening together and the fastener does not melt or scorch under heat.

Figure 5B:
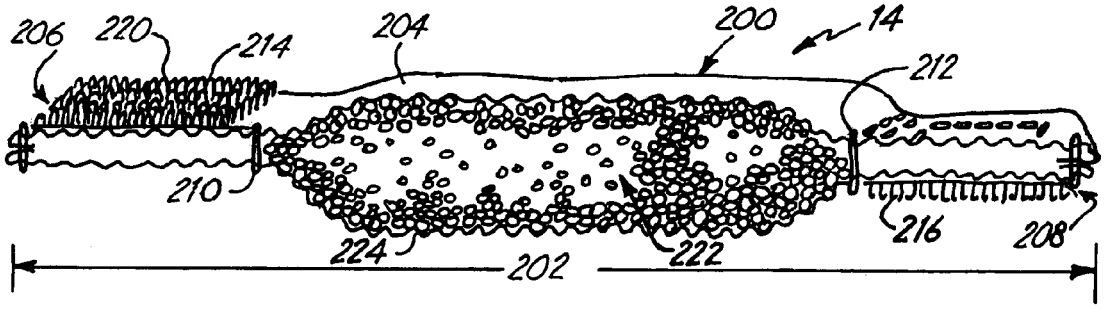
FIG. 5B is a perspective view of a section of the hair curler of FIG. 3A.

FIG. 5B is a perspective view of a section of hair curler 14 of FIG. 5A. The cross-section of hair curler 14 shows the following components: outer casing 200, axial curler length 202, body 204, first and second ends 206 and 208, first and second seams 210 and 212, first and second fasteners 214 and 216, interior cavity 222, and heat absorbent material 224. Outer casing 200 is the outermost layer of curler 14 and covers the entire curler 14. Interior cavity 222 forms the inside of body 204. Interior cavity 222 is filled with heat absorbent material 224, preferably in the form of silica beads or other desiccant material.

Heat absorbent material 224 fills interior cavity 222 of hair curler 14. Heat absorbent material 224 includes, but is not limited to, silica beads, buckwheat, flax seed, thermal gel, and any other desiccant material capable of releasing moisture when heated. In one embodiment, heat absorbent material 224 is in the form of silica beads, specifically 99.5% $SiO_2$; 0.021% $Na_2O$; 0.02% $Fe_2O_3$; 0.01% MgO; 0.04% Ca; 0.16% $A_{12}O_3$, and 0.01% other compounds (all percentages given are weight percentages). The grain size of each silica bead can vary from about 0.5 to 5.0 mm in diameter.

Silica beads are preferably used as heat absorbent material 224 because as a desiccant they adsorb moisture at room temperature and release moisture upon being heated to temperatures of approximately 250° F. to 350° F. When using the preferred embodiment of the present invention, post-heated silica beads release moisture and heat through outer casing 200 of hair curler 14 into the hair shaft. Thus, hair curler 14, when used according to the present invention, both moisturizes and curls hair at the same time. Once the hair cools, which takes about five minutes, the curls are set and the curlers may be removed.

Hygiene is important in personal care, especially if several people in a family are using the same styling tool. Styling products, such as hair spray and gel, can build up on hair curling tools. The build-up of old styling product on hair curling tools is unhygienic and not good for styling performance reasons. Fire-retardant fabric and silica, as used in the present invention, are machine washable and make curling hair with the present invention more sanitary than conventional methods. In addition, fabric is gentle on the hair, unlike bristles, plastic, and metal styling tools. Because outer casing 200 of curler 14 is made of soft fabric and the shape of curler 14 is not cylindrical, each curl produced by the present invention is unique—unlike curls produced by roller cylinders of consistent form and uniform shape.

Figure 6:
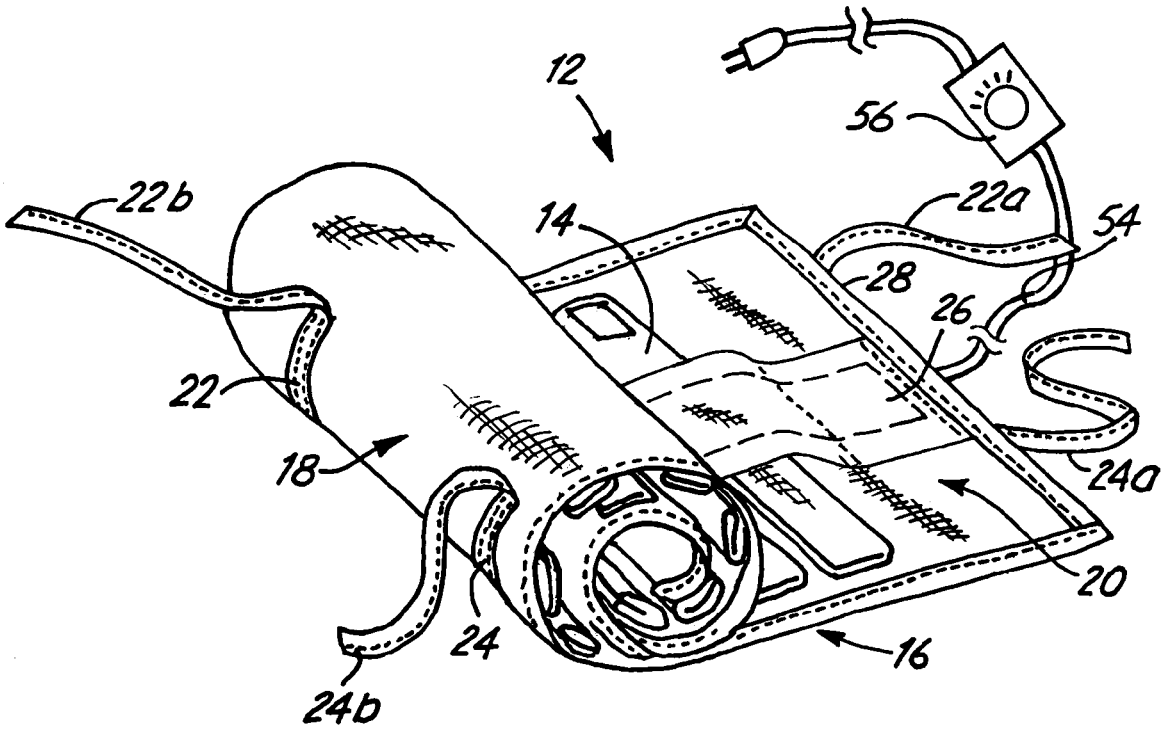
FIG. 6 is a perspective view of the first embodiment of the hair curling device of the present invention in a partially unrolled configuration exposing a set of hair curlers.

FIG. 6 is a perspective view of carrier 12 being used according to the first embodiment of the present invention. FIG. 6 shows the following features: blanket 16, strap 22 and its free end 22*a*, strap 24 and its free end 24*a*, exterior surface 18, interior surface 20, and center strap 26.

To use hair curling device 10, carrier 12 is heated in its fully rolled configuration (as shown in FIG. 1). Carrier 12 is connected to a power source by power cord 54, switched on by control box 56, and heated by heating element 52. Because curlers 14 are embedded in carrier 12 when carrier 12 is in the fully rolled configuration and heated, as heating element 52 reach temperatures of about 275° F., heat absorbent material 224 of curlers 14 are also heated. When carrier 12 is heated to the desired temperature, free ends 22*a* and 24*a* are untied and carrier 12 is preferably unrolled so that only one curler 14 is exposed at a time. Remaining curlers 14 remain inside carrier 12 where they stay warm while awaiting use.

Figure 7:
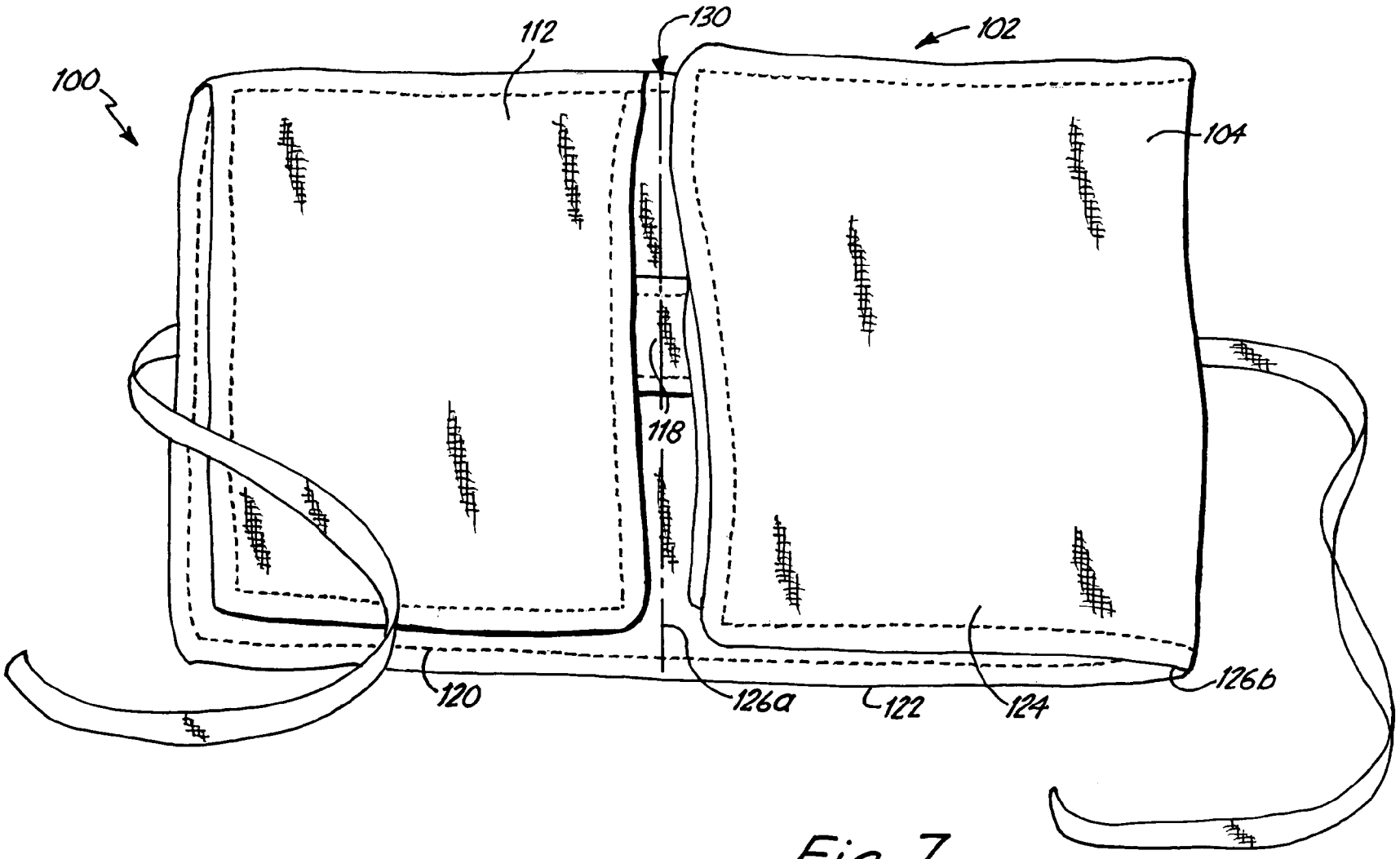
FIG. 7 is a perspective view showing the second embodiment of the hair curling device of the present invention in a partially unfolded configuration.
Figure 8:
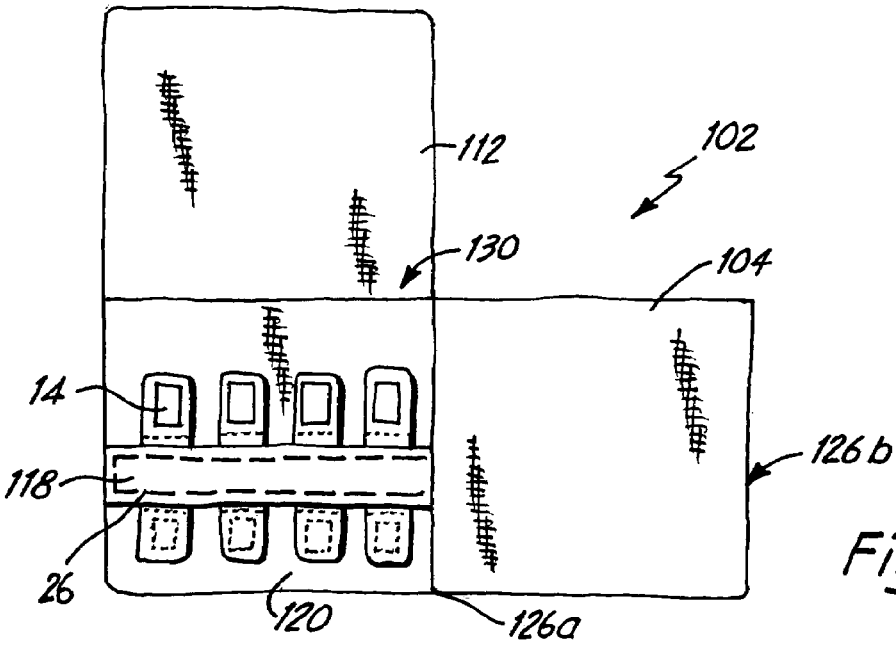
FIG. 8 is a perspective view showing the second embodiment of the hair curling device of the present invention in a partially unfolded configuration.
Figure 9:
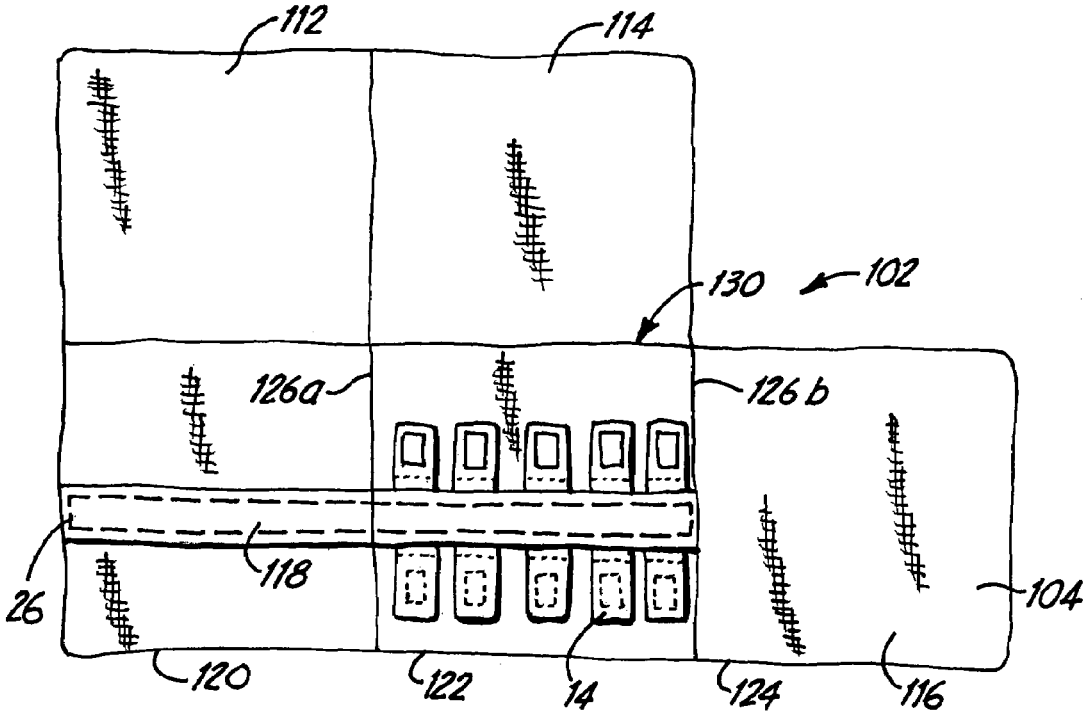
FIG. 9 is a perspective view showing the second embodiment of the hair curling device of the present invention in a partially unfolded configuration.

FIGS. 7, 8, and 9 are perspective views of carrier 102 being used according to the second embodiment of the present invention showing how carrier 102 is unfolded to reveal only one group of curlers 14 at a time. FIG. 8 shows one group of curlers 14 held in place against interior surface 110 under center strap 118 after first foldable extension 112 is unfolded along first side edge 130 of blanket 104. Remaining curlers 14 remain inside the folded portions of carrier 102 where they stay warm while awaiting use. Once all of curlers 14 currently exposed are removed from center strap 118, second portion 124 is unfolded along fold axis 126*b* and center foldable extension 114 is unfolded along first side edge 130 to expose another set of curlers 14 as shown in FIG. 9. Second foldable extension 116 remains folded over first side edge 130 until curlers 14 under first and center foldable extensions 112 and 114 are used and curlers 14 under second foldable extension 116 are needed.

Figure 10:
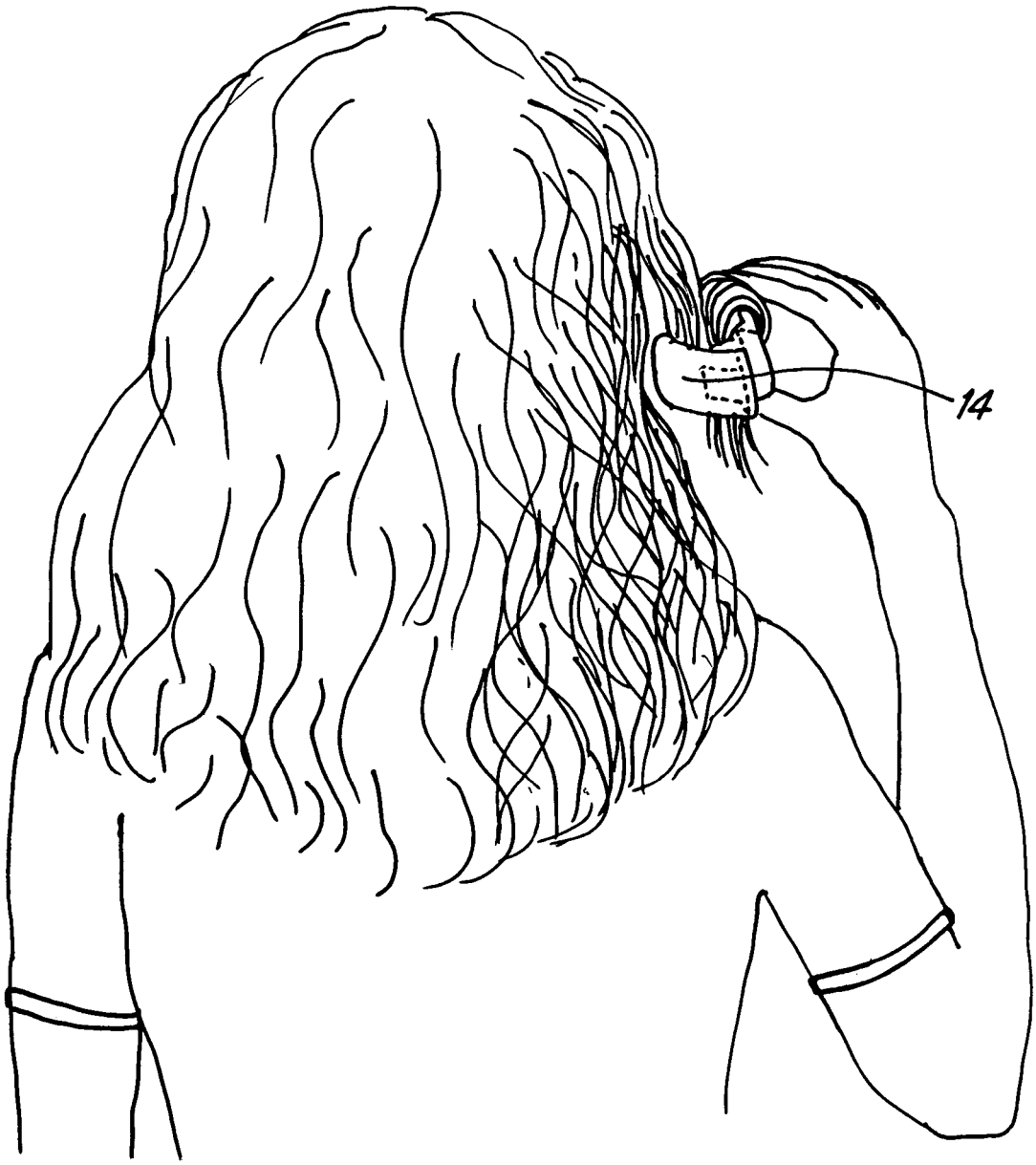
FIG. 10 is a rear view of a hair curler of the present invention placed in a section of hair.
Figure 11A:
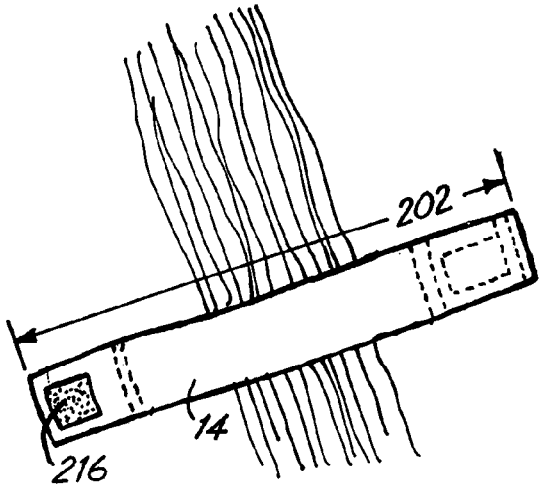
FIG. 11A shows the hair curler placed near the end of a section of hair to be curled.
Figure 11B:
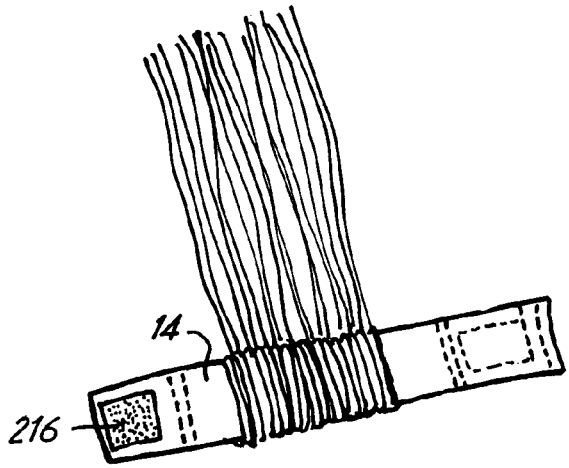
FIG. 11B shows the section of hair being wrapped around the hair curler of FIG. 10A.
Figure 11C:
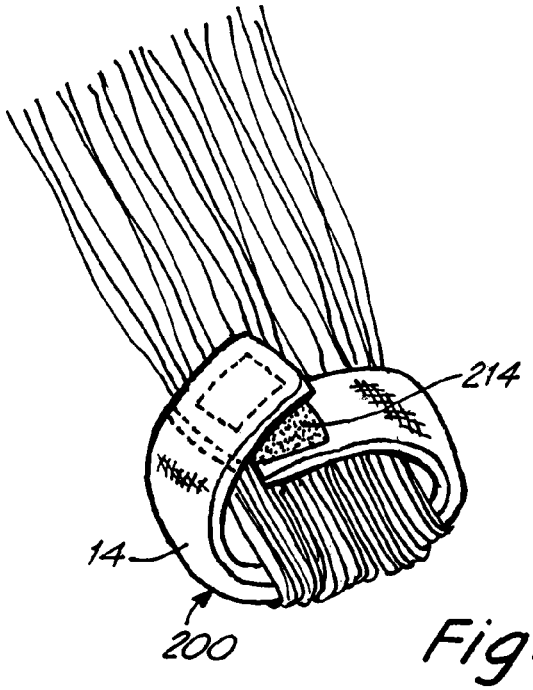
FIG. 11C shows the ends of the hair curler fastened together after the section of hair has been fully wrapped around the hair curler.

To use the present invention, human hair is first divided into sections that the user wishes to curl. Immediately after exposing a warm curler 14 as shown in FIG. 6, curler 14 is removed from carrier 12 and placed in the section of hair the user wishes to curl, as shown in FIG. 10. FIGS. 11A through 11C show the steps involved in using the present invention after a warm curler 14 has been removed from carrier 12. FIG. 11A shows curler 14 placed at the end of a section of hair that a user wishes to curl. FIG. 11B shows wrapping a section of hair around outer casing 200 of curler 14. Hair may be wrapped either over or under curler 14, depending on the desired curl. Once a section of hair is fully wrapped around curler 14, curler 14 is fastened together to hold the curl in place. FIG. 11C shows a rear view of a user securing curler 14 in place by bending curler 14 along its axial length 202 and attaching first fastener 214 (shown in FIG. 11A) to second fastener 216. Because hair is wound multiple times around hair curler 14 (see FIG. 11B and FIG. 11C), curler 14 will not fall out. Curler 14 is lightweight and easy to fasten in place. For each additional section of hair a user wishes to curl, another warm curler 14 is removed from carrier 12 while remaining curlers 14 stay warm inside carrier 12. The steps shown in FIG. 11A through FIG. 11C are repeated for each additional hair section. Once the wrapped hair cools (approximately 5 minutes), curlers 14 are removed, leaving a natural wavy curl that is easy to style. Although FIGS. 10 and 11A-11C discuss using curler 14 in reference to carrier 12 of the first embodiment of hair curling device 10, curler 14 is used with carrier 102 of the second embodiment of hair curling device 100 in the same manner.

The present invention provides a fast, safe, clean, and easy way to curl hair. Whereas previous hair curling devices were effective at curling hair, their intense heat dried out the user's hair and posed a risk of burning the user's skin. In addition, devices heated with electrical heat put the user at risk of electrical shock and limited the user's movement to the range of the electric cord. The present invention solves these problems by providing a hair curling device whose use of heat does not dry out the hair, is warm (not hot) to the touch, and is simple to wrap hair around and hold in place. In addition, the carrier of the present invention solves the cumbersome and time-consuming process of having to heat individual curlers in the microwave. The power cord attached to the heating elements housed in the carrier allows all the curlers to be heated together in one easy step, requires nothing more than an electrical outlet, and prevents the curlers from losing heat. The carrier also provides a place to store curlers between uses so that the curlers are not lost or misplaced.

Although the present invention has been described with reference to preferred embodiments, workers skilled in the art will recognize that changes may be made in form and detail without departing from the spirit and scope of the invention.

The invention claimed is:

1. A heatable hair curling device comprising:

a plurality of hair curlers for winding up human hair, each of the plurality of hair curlers comprising an elongate casing of flexible material having opposite first and second ends, a body, and an axial length, the first and second ends being attachable to each other;

a heat absorbent material contained within the body of each of the plurality of hair curlers;

a thermally insulating carrier for retaining the plurality of hair curlers, the carrier having a length, the carrier comprised of an interior and an exterior piece of flexible heat-safe material, the interior piece of flexible heat-safe material attached to the exterior piece of flexible heat-safe material, wherein the carrier insulates the plurality of hair curlers from heat loss prior to individual hair curler use;

a center strap disposed along a length of the interior piece of flexible heat-safe material of the carrier, the center strap comprised of a lower and an upper piece of flexible heat-safe material; and a heating element contained between the interior and exterior pieces of flexible heat-safe material of the carrier and between the lower and upper pieces of flexible heat-safe material of the center strap;

wherein the carrier is divided into a first portion, a center portion, and a second portion by a first fold axis and a second fold axis, the first fold axis located between the first portion and the center portion, and the second fold axis located between the center portion and the second portion, wherein the first portion and the second portion are sized to overlap the center portion, and wherein the plurality of hair curlers are disposed between the interior piece of flexible, heat-safe material and the center strap at the first portion, the center portion, and the second portion of the carrier.

2. The hair curling device of claim 1, wherein the plurality of hair curlers are secured between the center strap and the interior piece of flexible heat-safe material such that the axial length of each of the plurality of hair curlers is perpendicular to the length of the carrier.

3. The hair curling device of claim 1, and further comprising a power cord connectable to a power source for supplying power to the heating element.

4. The hair curling device of claim 1, wherein the heating element is capable of obtaining temperatures of at least about 275° F.

5. The hair curling device of claim 1, wherein the heat absorbent material expels moisture when heated to a temperature between approximately 250-350° F.

6. The hair curling device of claim 5, wherein the heat absorbent material is selected from a group consisting of silica, buckwheat, flax-seed, and thermal gel.

7. The hair curling device of claim 1, wherein the carrier further comprises a plurality of foldable extensions attached to the interior and exterior pieces of flexible heat-safe material.

8. The hair curling device of claim 7, wherein the plurality of foldable extensions comprises a first, a second, and a third foldable extension, the first foldable extension attached to the first portion of the carrier, the center foldable extension attached to the center portion of the carrier, and the second foldable extension attached to the second portion of the carrier.

9. The hair curling device of claim 8, wherein the first foldable extension is folded over the first portion of the carrier toward the interior piece of flexible heat-safe material, the center foldable extension is folded over the center portion of the carrier toward the interior piece of flexible heat-safe material, and the second foldable extension is folded over the second portion of the carrier toward the interior piece of flexible heat-safe material.

10. The hair curling device of claim 9, wherein the first portion of the carrier is folded along the first fold axis toward the interior piece of flexible heat-safe material and the second portion of the carrier is folded along the second fold axis toward the interior piece of flexible heat-safe material when the carrier is in a fully folded configuration.

11. A heatable hair curling device comprising:

a plurality of hair curlers, each of the plurality of hair curlers used individually; and a carrier comprising:

a thermally insulating elongate blanket of flexible heat-safe material, the blanket having an interior surface and an exterior surface;

a central strap disposed on the interior surface of the blanket for holding the plurality of hair curlers in place;

a fastening device disposed on the exterior surface of the blanket for keeping the blanket in a closed configuration; and a heating element;

wherein the carrier is divided into a first portion, a center portion, and a second portion by a first fold axis and a second fold axis, the first fold axis located between the first portion and the center portion, and the second fold axis located between the center portion and the second portion, wherein the first portion, the center portion, and the second portion are about equal in size, and wherein the plurality of hair curlers are disposed between the interior surface of the thermally insulating elongate blanket and the center strap at the first portion, the center portion, and the second portion of the carrier.

12. The hair curling device of claim 11, wherein the heating element is disposed within the blanket.

13. The hair curling device of claim 11, wherein the heating element is disposed within the center strap.

14. The hair curling device of claim 11, wherein the heating element is capable of obtaining temperatures of at least about 275° F.

15. The hair curling device of claim 11, wherein the flexible heat-safe material comprises a fabric capable of withstanding temperatures of at least about 250° F.

16. The hair curling device of claim 15, wherein the flexible heat-safe material comprises a fire-retardant fiber capable of withstanding temperatures of at least about 600° F.

17. The hair curling device of claim 11, wherein the carrier is configured to be unfolded to reveal only a portion of the plurality of curlers at a time.

18. The hair curling device of claim 11, wherein the carrier is configured to be unrolled to reveal only one of the plurality of curlers at a time.

19. The hair curling device of claim 11, and further comprising a power cord connectable to a power source for supplying power to the heating element.

* * * * *